United States Patent [19]

Grasshoff

[11] 4,138,348

[45] Feb. 6, 1979

[54] LUBRICANT FOR USE IN NON-CHIP METAL FORMING

[75] Inventor: Hans D. Grasshoff, Hamburg, Fed. Rep. of Germany

[73] Assignee: Deutsche Texaco Aktiengesellschaft, Fed. Rep. of Germany

[21] Appl. No.: 475,484

[22] Filed: Jun. 3, 1974

[30] Foreign Application Priority Data

Jun. 16, 1973 [DE] Fed. Rep. of Germany ..... 2330806

[51] Int. Cl.[2] ..... C10M 1/54

[52] U.S. Cl. ..... 252/42.1; 252/18; 252/49.5

[58] Field of Search ..... 252/18, 42.1, 49.5

[56] References Cited

U.S. PATENT DOCUMENTS

| | | | |
|---|---|---|---|
| 2,040,321 | 5/1936 | Lutz | 252/42.1 X |
| 2,565,938 | 8/1951 | Williams | 252/49.5 X |
| 2,609,780 | 9/1952 | Whitbeck | 252/18 X |
| 2,626,898 | 1/1953 | Dilworth et al. | 252/42.1 |
| 2,664,399 | 12/1953 | Kluender | 252/18 |
| 2,753,304 | 7/1956 | Orozco | 252/18 |
| 2,958,659 | 11/1960 | Brown | 252/18 |
| 3,223,635 | 12/1965 | Dwyer et al. | 252/49.5 X |
| 3,313,729 | 4/1967 | Glasson | 252/18 |
| 3,483,124 | 12/1969 | Johnson | 252/49.5 |
| 3,758,407 | 9/1973 | Harting | 252/18 |

OTHER PUBLICATIONS

Bastian, E. L. H., "Metalworking Lubricants", 1951, pp. 14 and 69.

*Primary Examiner*—Delbert E. Gantz
*Assistant Examiner*—Andrew Metz
*Attorney, Agent, or Firm*—Carl G. Ries; Thomas H. Whaley; Kenneth R. Priem

[57] ABSTRACT

The present invention is a water soluble, pasty lubricant containing a base material comprising a neutral fat and/or a vegetable oil, an alkali metal soap, water and an alkali metal salt of a boric acid. The lubricant has particular advantage for use in non-chip metal forming.

8 Claims, No Drawings

LUBRICANT FOR USE IN NON-CHIP METAL FORMING

BACKGROUND OF THE INVENTION

Forging, rolling, and drawing are important fields in non-chip metal forming. All lubricants necessary for these metal working techniques are intended to ease the processing methods and to help improve the manufactured working parts.

In the field of drawing, differences exist between press drawing, tube drawing, rod drawing, bar drawing, and wire drawing. In the field of press drawing, especially deep drawing of sheet metal is of interest with regard to lubrication. For example, soap solutions, water soluble oil emulsions with or without chemically active additives, dry soap films and phosphate coatings were proposed and employed as the drawing media (agents) in deep drawing. In tube and rod drawing, drawing oils, soaps, or drawing greases serve as the lubricants. In tube drawing, the selection of lubricants is dependent on the pretreatment of the tubes. The lubricants employed in wire drawing are, for instance, dry soap compounds, drawing agent solutions as emulsions with different emulsifiers and further additives, as well as drawing oils and drawing greases.

German Auslegeschrift No. 1,088,646 teaches the use of boric acid or boric acid compounds which comprise at least one free hydroxyl group at the boric atom, in equimolar mixture with natural or synthetic resins having one or more free carboxyl and/or hydroxyl groups, in a mineral oil as the drawing lubricants. Using this mixture, a drawing lubricant of improved pressure loading capacity is obtained.

According to the process disclosed in German Auslegeschrift No. 1,030,954, a light granular non-sticky lubricant is obtained for the use in lubricating metal prior to its forming, said lubricant being composed of a fatty acid, soda, sodium chloride, borax and water. In describing said invention it was indicated that a quick dissolving of said lubricant on account of its granular porous consistency and its small particle size may be accomplished only by using soda and not by introducing sodium hydroxide, much less by adding potash or potassium hydroxide.

It is the object of the present invention to check the existing bias as exemplified in the description of the afore-mentioned German Auslegeschrift and provide improved lubricants for non-chip metal forming.

SUMMARY OF THE INVENTION

The invention is a consistent lubricant for non-chip metal forming, the lubricant containing no mineral oil and being water soluble and pasty. The following components are employed in producing the lubricant of the invention.

a. a neutral fat and/or vegetable oil as a base material,
b. a fatty acid or a mixture of fatty acids,
c. an alkali metal hydroxide,
d. water and
e. an alkali metal salt of a boric acid.

The finished lubricant comprises a neutral fat and/or vegetable oil, an alkali metal soap, water and a borate of an alkali metal.

DESCRIPTION OF THE PREFERRED EMBODIMENTS

By the term "neutral fat" an animal fat is meant, that portion which is not saponified by the alkali metal hydroxide added to the batch and which is commercially available as tallow. It is preferred to employ beef tallow in the lubricant of the invention, said beef tallow substantially consisting of palmitic acid, stearic acid, oleic acid, and linoleic acid esterified with glycerin. According to the invention one may also employ a vegetable oil instead of a neutral fat or both together in said lubricant batch. Examples of vegetable oils include colza oil (rape oil), mustard oil, linseed oil, olive oil, soybean oil, or coconut palm oil. Especially preferred are rape oil, coconut oil or palm-kernel oil.

The term "fatty acid" includes all fatty acids that may be recovered by known methods from the neutral fat or vegetable oils and normally are present as a mixture, for example, of the fatty acids defining the composition of the fat or vegetable oil. These fatty acids comprise from 10 to 35 carbon atoms, preferably from 10 to 25 carbon atoms. The mixture of fatty acids obtained from the saponification of said tallow can be employed directly to formulate said lubricant, without additional treatment for further refining, although said fatty acid may be subjected to a curing process. It is within the scope of the invention if, instead of the fatty acid mixtures obtained as described, fatty acids alone such as stearic acid, palmitic acid, margaric acid, myristic acid, oleic acid or linoleic acid are used. In general, however, technical grade, commerical acids are employed for reasons of cost, said acids comprising in addition to the desired acid forming the main component further components having no influence on the properties of the lubricant of the invention.

In the in situ production of metal soap, a hydroxide of an alkali metal is added to the charge mixture consisting of neutral and/or oil and fatty acid, in an amount sufficient for soap formation. Potassium hydroxide and sodium hydroxide proved to be advantageous in the production of said lubricant and they are employed in an amount sufficient for soap formation, but insufficient for saponification of the fat or the oil.

Alkali metal salts of boric acids as a component of the lubricant are an essential of the invention, since, as is shown in testing the lubricant batches, without these salts the lubricant is not obtained with the advantageous properties inviting for use in forming metals. The boric acid salts, or borates, are derived from boric acid and m-boric acid as well as from formulae of reduced water content. The technically most important borates derive from the heptoxotetraboric acid, and for the lubricant of the invention, it is preferred to employ alkali metal tetraborates of the general formula $Me_2B_4O_7$, wherein Me is a Group Ia metal. The amounts of the components to be employed are determined by the following ranges, in percent by weight (based on the finished formulation):

| | |
|---|---|
| neutral fat or oil | 20 to 50% |
| soap content | 10 to 30% |
| borate | 0.5 to 6% |
| water | balance |

Another important feature of the invention, apart from the presence of borate, is the ratio of neutral fat and/or oil to soap in the finished lubricant. The best results are obtained when the base material of neutral fat and/or oil to soap ratio is from about 2 to 3:1.

The lubricants are produced such that the fatty acid and the fat and/or oil are charged to a container and heated to a temperature of about 80° C. At this temperature, the hydroxide dissolved in water is added to the batch to form soap. After completion of the soap formation, the remaining water and borate is added under intensive stirring. For the purpose of testing said lubricant the penetration measurement according to DIN Standard No. 51 804 is carried out as well as measuring the pressure loading capacity according to DIN Standard No. 51 350 on a 4-ball apparatus.

The tests and the results thereof are summarized in the Table. Test A is carried out without the addition of borate and served as an example for comparison. The results of tests B, C and D illustrate the high pressure loading capacity of the lubricant of the invention as compared to Test A.

As a result of using the lubricant of the invention in deep drawing, the number of perfect worked pieces, i.e., pieces without scoring, cracking and the like, is very high, and in wire drawing the wear of die and wire is found to be strongly reduced.

TABLE

| Example | A | B | C | D |
|---|---|---|---|---|
| Starting Materials kg | | | | |
| Fatty acid | Fish oil fatty acid, hardened 180 | Tallow fatty acid 170 | Stearic acid 200 | Fish oil fatty acid, hardened 100 |
| Fat/Oil | Tallow 400 | Tallow 380 | Rape Seed Oil 400 | Tallow 250 |
| Hydroxide | KOH 37 | KOH 35 | NaOH 29 | KOH 21 |
| Borate | — | $Na_2B_4O_7$ 20 | $K_2B_4O_7$ 20 | $Na_2B_4O_7$ 50 |
| $H_2O$ | 383 | 395 | 351 | 579 |
| Test Results | | | | |
| Penetration measurement | 180 mm/10 | 200 mm/10 | 220 mm/10 | 240 mm/10 |
| Pressure loading capacity measurement | 1200 N | 1600 N | 1800 N | N N |

What is claimed is:

1. A lubricant comprising:

(a) 20 to 50 weight percent of a base material selected from the group consisting of a neutral fat and a vegetable oil, (b) 10 to 30 weight percent of an alkali metal soap, (c) 0.5 to 6 weight percent of an alkali metal salt of a boric acid, and (d) water, the remainder.

2. The lubricant according to claim 1 wherein the base material is an animal fat.

3. The lubricant according to claim 1 wherein said base material and said soap are present in a ratio of from about 2 to 3:1, respectively.

4. The lubricant according to claim 1 wherein a fatty acid is obtained by saponification of a portion of said fat or oil and containing from 10 to 35 carbon atoms or mixtures of said fatty acids are used for forming the soap.

5. The lubricant according to claim 1 wherein the base material is vegetable oil.

6. The lubricant according to claim 1 wherein the alkali metal salt of a boric acid are the alkali metal salts of neptoxotetraboric acid.

7. A lubricant according to claim 6 wherein said alkali metal salt of boric acid is sodium tetraborate.

8. A lubricant according to claim 6 wherein said alkali metal salt of boric acid is potassium tetraborate.

* * * * *